United States Patent [19]

Swenson

[11] Patent Number: 4,662,609

[45] Date of Patent: May 5, 1987

[54] CAPSTAN ADAPTABLE "V" PULLER

[75] Inventor: Richard C. Swenson, Carriere, Miss.

[73] Assignee: The United States of America as represented by the Secretary of the Navy, Washington, D.C.

[21] Appl. No.: 370,309

[22] Filed: Apr. 21, 1982

[51] Int. Cl.[4] ..... B66D 1/30; B65H 75/18

[52] U.S. Cl. ..... 254/371; 254/266; 242/117

[58] Field of Search ..... 254/262, 278, 279, 266, 254/323, 371, 380; 242/117

[56] References Cited

U.S. PATENT DOCUMENTS

| | | | |
|---|---|---|---|
| 1,024,592 | 4/1912 | Moser | 254/264 |
| 3,946,618 | 3/1976 | Green | 242/117 |
| 4,274,606 | 6/1981 | Bernwall et al. | 242/117 |

*Primary Examiner*—Stuart S. Levy
*Assistant Examiner*—David Werner
*Attorney, Agent, or Firm*—Thomas M. Phillips

[57] ABSTRACT

A capstan adaptable "V" puller fitted with a plurality of vertical staves and is positioned on a "host" capstan. The staves are adjusted to the diameter of the capstan and securely clamped in place by any suitable means. Friction is enhanced by rubber pads mounted between the contact surface of the capstan and the staves.

4 Claims, 2 Drawing Figures

CAPSTAN ADAPTABLE "V" PULLER

FIELD OF THE INVENTION

The present invention realtes to devices for hauling in lines, and more particularly to a "V" puller adaptable for attachment to a ship's existing capstan.

DESCRIPTION OF THE PRIOR ART

Currently for deep sea buoy moorings, such as current meter, thermistor and hydrophone arrays, special deck winches arerequired to recover these devices from the deep sea. These winches are expensive, heavy and require deck space, special operator skills and repetitive maintenance. They also are logistically difficult, requiring transportation to a host ship, lifting onboard and welding to the deck, and then the reverse process when the operation is completed. Additionally, as the winch drum becomes full, the mooring system or array has to be transferred off the drum before the next array can be recovered, and sensors in rhe array become buried on the drum and are subjected to the compressive loads of subsequent line layers which can damage them.

A "V" puller has the advantage of only requiring a 180° wrap by the line being pulled as opposed to several 360° wraps on a capstan, allowing lines, electromechanical ropes or sensor arrays with modest size obstructions such as shackles, end fittings, sensors, connectors and fairings to be hauled in under load without stopping to accommodate these devices. Furthermore, the "V" puller is normally two to three times the diameter of the ship's mooring capstan creating a greater inhaul speed and increasing the bending radius. However, ship's masters are averse to having ship's equipment modified to accommodate transient equipment which is relatively infrequently used by the ship.

Therefore, a quick method for attaching a "V" puller to a ship's capstan without requiring modification of the capstan is desired.

SUMMARY OF THE INVENTION

Accordingly, the present invention provides a capstan adaptable "V" puller. A "V" puller is fitted with a plurality of vertical staves and is positioned on a "host" capstan. The staves are adjusted to the diameter of the capstan and securely clamped in place by any suitable means. Friction is enhanced by rubber pads mounted between the contact surface of the capstan and the staves.

Thus, it is an object of this invention to provide a quick, economic method for attaching a "V" puller to a ship's capstan.

Other objects, advantages and novel features of the present invention will be apparent from the following detailed description when read in conjunction with the appended claims and attached drawing.

DESCRIPTION OF THE PREFERRED EMBODIMENT

Figure 1:
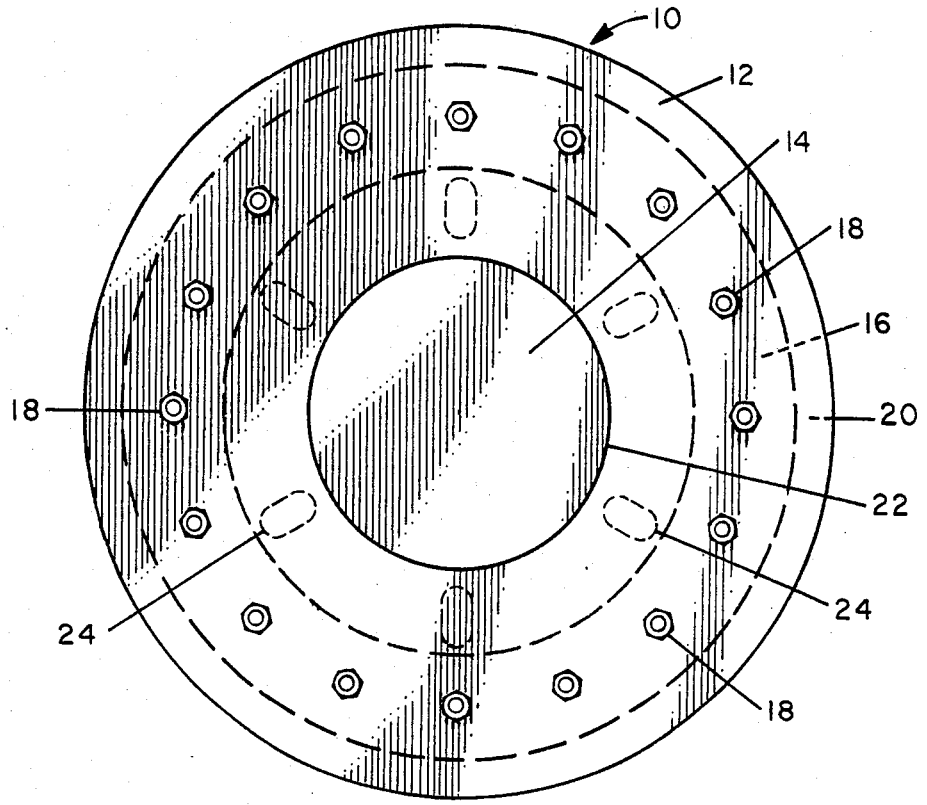
FIG. 1 is a top plan view of a "V" pulley which is adaptable for attachment to a ship's capstan.
Figure 2:
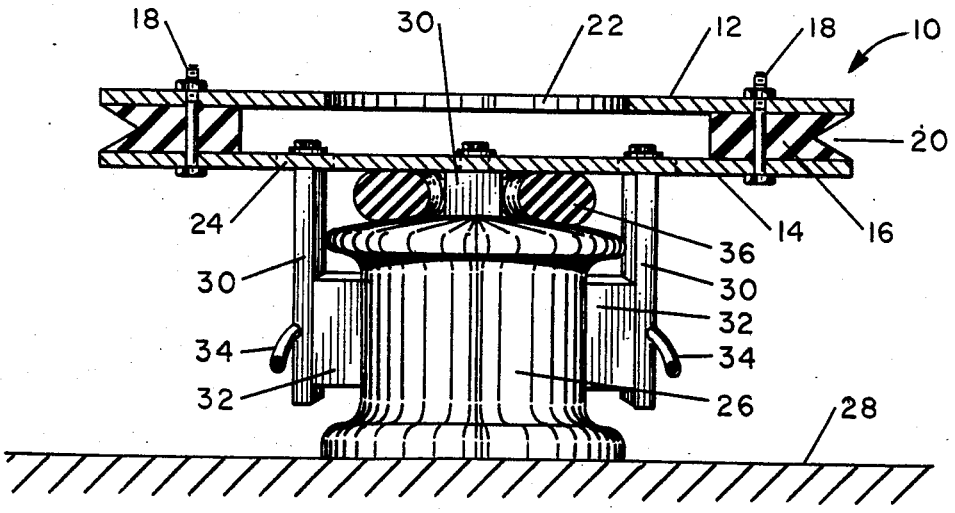
FIG. 2 is a partial cross-section view of the "V" puller attached to the capstan.

Referring now to FIGS. 1 and 2, a representative "V" puller 10 is shown. A top plate 12 and a bottom plate 14 form a sandwich with an elastomeric toroid 16 as the filling. The sandwich is rigidly connected together by any suitable means such as nuts and bolts 18, rivets or the like. The outer edge 20 of the torroid 16 is in the form of a V, from which the "V" puller derives its name. The upper plate 12 has a central hole 22 to allow access to the interior of the sandwich. The bottom plate 14 has a plurality of slots 24 interior to the toroid 16 extending in a radial direction.

To connect the "V" puller to a capstan 26 secured to the deck 28 of a ship a plurality of staves 30 are adjustably connected to the lower plate 14 via the slots 24. On the interior face of each stave 30 an elastic pad 32 is attached by any suitable means to enhance friction between the staves and the contact surface of the capstan 26. Means 34 such as bands, cables, a chain and turnbuckle system or the like are provided to clamp the staves 30 securely against the contact surface of the capstan 26. A cushion 36, such as a rubber tire, may also be placed between the lower plate 14 of the "V" puller 10 and the top of the capstan 26 to maintain the puller in an essentially horizontal position.

In operation the "V" puller 10 and associated staves 30 are transported to a host ship. The "V" puller 10 is attached to the ship's capstan 26 by placing the puller above the capstan such that the staves 30 surround the capstan. The staves 30 are adjusted uniformly so that the pads 32 make contact with the surface of the capstan 26. The clamping means 34 are tightened to securely fasten the "V" puller 10 to the capstan 26. Operation of the capstan 26 now serves to operate the "V" puller 10 which can be done by the ordinary seaman. A mooring system or sensor array being recovered via the puller 10 can be coiled directly into an appropriate storage receptacle. When the operation is completed for which the "V" puller 10 is required, the puller can easily be removed and stored, leaving the capstan 26 free for regular shipboard operations.

Thus, the present invention provides a means for providing recovery of deep sea mooring systems and sensor arrays by attaching a "V" puller to a ship's capstan without requiring modification of the capstan or interference with regular shipboard capstan operations while at the same time being simple to operate. This means provides a simple, inexpensive recovery apparatus for buoy mooring lines and sensor arrays by using existing ship's deck machinery and personnel; and it allows for the passage of sensors and connectors around a large bending radius, delivering the array or line free of tension to a coiling box in which the components are not subjected to compressive loads, are available for repair or calibration, and are in the right order for subsequent redepolyments.

What is claimed is:

1. An apparatus for recovering deep sea mooring systems comprising:

a "V" puller;

a plurality of vertical staves adjustably attached to the underneath of said "V" puller; and means for clamping said staves to the contact surface of a capstan.

2. A capstan adaptable "V" puller comprising:

a "V" puller having an upper plate with a central hle, a lower plate with a plurality of radial slots, and an elastomeric toroid secured between said upper and lower plates to form a ridig sandwich, said elastomeric toroid having a V notch around the peripher;

a plurality of vertical staves adjustably connected through said radial slots to said lower plate and extending downward therefrom;

a pad attached to the interior surface of each of said vertical staves to contact the bearing surface of a capatan; and means for securely clamping said staves axially along the bearing surface of said capstan.

3. A capstan adaptable "V" puller as recited in claim 2 further comprising a toroidal cushion placed between said lower plate and the head of said capstan to maintain said "V" puller in an essentially horizontal position.

4. A capstan adaptable "V" puller as recited in claims 2 or 3 wherein said clamping means comprises a chain and turnbuckle system, said chain lying in slots on the exterior face of said staves such that when said turnbuckle is turned said chain compresses said staves against the bearing surface of said capstan.

* * * * *